US010953337B1

(12) United States Patent
Robarge

(10) Patent No.: US 10,953,337 B1
(45) Date of Patent: Mar. 23, 2021

(54) ILLUMINATED OUTDOOR FIGURINES

(71) Applicant: Robin Robarge, Londonderry, NH (US)

(72) Inventor: Robin Robarge, Londonderry, NH (US)

( * ) Notice: Subject to any disclaimer, the term of this patent is extended or adjusted under 35 U.S.C. 154(b) by 0 days.

(21) Appl. No.: 16/565,656

(22) Filed: Sep. 10, 2019

(51) Int. Cl.
*G09F 19/08* (2006.01)
*A63H 3/00* (2006.01)
*H05B 45/00* (2020.01)

(52) U.S. Cl.
CPC ..... *A63H 3/006* (2013.01); *G09F 19/08* (2013.01); *H05B 45/00* (2020.01)

(58) Field of Classification Search
CPC ..... G09F 19/08; F21S 4/10; Y10S 362/806; Y10S 362/808; F21W 2121/00; F21V 21/0824; H05B 45/00; A63H 3/006
USPC ..... 446/484, 485; 362/227, 234, 249.01, 362/249.02, 249.16, 311.13, 320, 806, 362/808, 249.06; 40/540
See application file for complete search history.

(56) References Cited

U.S. PATENT DOCUMENTS 2,748,256 A * 5/1956 Moran ..... A63H 3/006 362/362
3,220,130 A * 11/1965 Falkenberg ..... G09F 13/00 40/564
3,835,308 A * 9/1974 Reese ..... F21S 4/10 362/362
5,436,817 A * 7/1995 Wotton ..... A47G 33/0836 362/124
5,566,483 A * 10/1996 Ogren ..... G09F 13/08 40/564
5,613,764 A * 3/1997 O'Brien ..... F21S 8/00 362/307
D392,208 S 3/1998 Chong
5,784,815 A * 7/1998 Hermanson ..... G09F 19/08 40/414
5,911,501 A * 6/1999 Katz ..... F21V 17/164 362/124
6,180,193 B1 * 1/2001 Bostedt ..... A63H 3/006 362/806
6,224,231 B1 * 5/2001 Personius ..... F21V 19/04 362/123
6,345,457 B1 * 2/2002 Bradley ..... G09F 19/02 40/410
6,539,655 B1 * 4/2003 Earle ..... G09F 19/08 223/66

(Continued)

FOREIGN PATENT DOCUMENTS

WO 2003035202 5/2003

*Primary Examiner* — Alexander R Niconovich

(57) ABSTRACT

The illuminated outdoor figurine is a decorative structure. The illuminated outdoor figurine is an illuminating structure. The illuminated outdoor figurine is a self-supporting structure. Any first instantiation of the illuminated outdoor figurine electrically connects with any second instantiation of the illuminated outdoor figurine. The illuminated outdoor figurine comprises a figurine, a lighting circuit, an external lamp circuit, and an external power source. The figurine contains the lighting circuit. The external lamp circuit is suspended from the exterior surface of the figurine. The external power source provides a source of electrical energy that powers the lighting circuit and the external lamp circuit.

12 Claims, 4 Drawing Sheets

(56) References Cited

U.S. PATENT DOCUMENTS 6,672,738 B1 * 1/2004 Lewis ..... A47G 33/06 315/185 S
6,955,581 B1 * 10/2005 Liu ..... G09F 19/08 446/219
7,216,446 B2 * 5/2007 Machala ..... G09F 15/00 40/610
7,302,769 B2 * 12/2007 Machala ..... G09F 15/0025 40/610
7,311,580 B2 * 12/2007 Moomaw ..... G09F 15/00 40/412
7,322,137 B2 * 1/2008 Machala ..... G09F 19/00 40/410
7,661,847 B2 * 2/2010 Wang ..... A47G 33/06 362/249.16
7,878,685 B2 * 2/2011 Wang ..... A47G 33/06 362/249.16
7,878,878 B2 * 2/2011 Massaro ..... A63H 3/24 446/296
8,234,804 B1 * 8/2012 Rush ..... G09F 13/18 40/546
8,262,243 B1 * 9/2012 Pasdar ..... H05B 47/155 362/124
8,469,538 B2 * 6/2013 Leung ..... F21V 3/026 362/155
9,448,002 B2 * 9/2016 Asperas ..... B29D 22/04
9,523,486 B2 * 12/2016 Boyink ..... F21V 23/02
2001/0013188 A1 * 8/2001 Hall ..... G09F 19/08 40/610
2002/0141189 A1 * 10/2002 Lin ..... F21S 10/00 362/294
2005/0180163 A1 * 8/2005 Huang ..... G02B 6/0008 362/568
2006/0025037 A1 * 2/2006 Lau ..... G09F 15/0025 446/226
2007/0097685 A1 * 5/2007 Gan ..... F21S 4/10 362/249.16
2008/0117632 A1 * 5/2008 Li ..... F21V 9/32 362/249.16
2009/0129089 A1 * 5/2009 Lavallee ..... A47G 33/06 362/249.16
2009/0156089 A1 * 6/2009 Hoard ..... A63H 3/001 446/297
2009/0170398 A1 * 7/2009 Chang ..... A63H 33/22 446/219
2011/0085327 A1 * 4/2011 Chen ..... F21S 6/001 362/235

* cited by examiner

ILLUMINATED OUTDOOR FIGURINES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports, games, and amusements including dolls, more specifically, a doll provided with electric lighting. (A63H3/006)

SUMMARY OF INVENTION

The illuminated outdoor figurine is a decorative structure. The illuminated outdoor figurine is an illuminating structure. The illuminated outdoor figurine is a self-supporting structure. Any first instantiation of the illuminated outdoor figurine electrically connects with any second instantiation of the illuminated outdoor figurine. The illuminated outdoor figurine comprises a figurine, a lighting circuit, an external lamp circuit, and an external power source. The figurine contains the lighting circuit. The external lamp circuit is suspended source provides a source of electrical energy that powers the lighting circuit and the external lamp circuit.

These together with additional objects, features and advantages of the illuminated outdoor figurine will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated outdoor figurine in detail, it is to be understood that the illuminated outdoor figurine is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated outdoor figurine.

It is therefore important that the claims be regarded as including such equivalent construction insofar as they do not depart from the spirit and scope of the illuminated outdoor figurine. It is also to be understood that the phraseology and terminology employed herein are for purposes of description and

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention.

They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
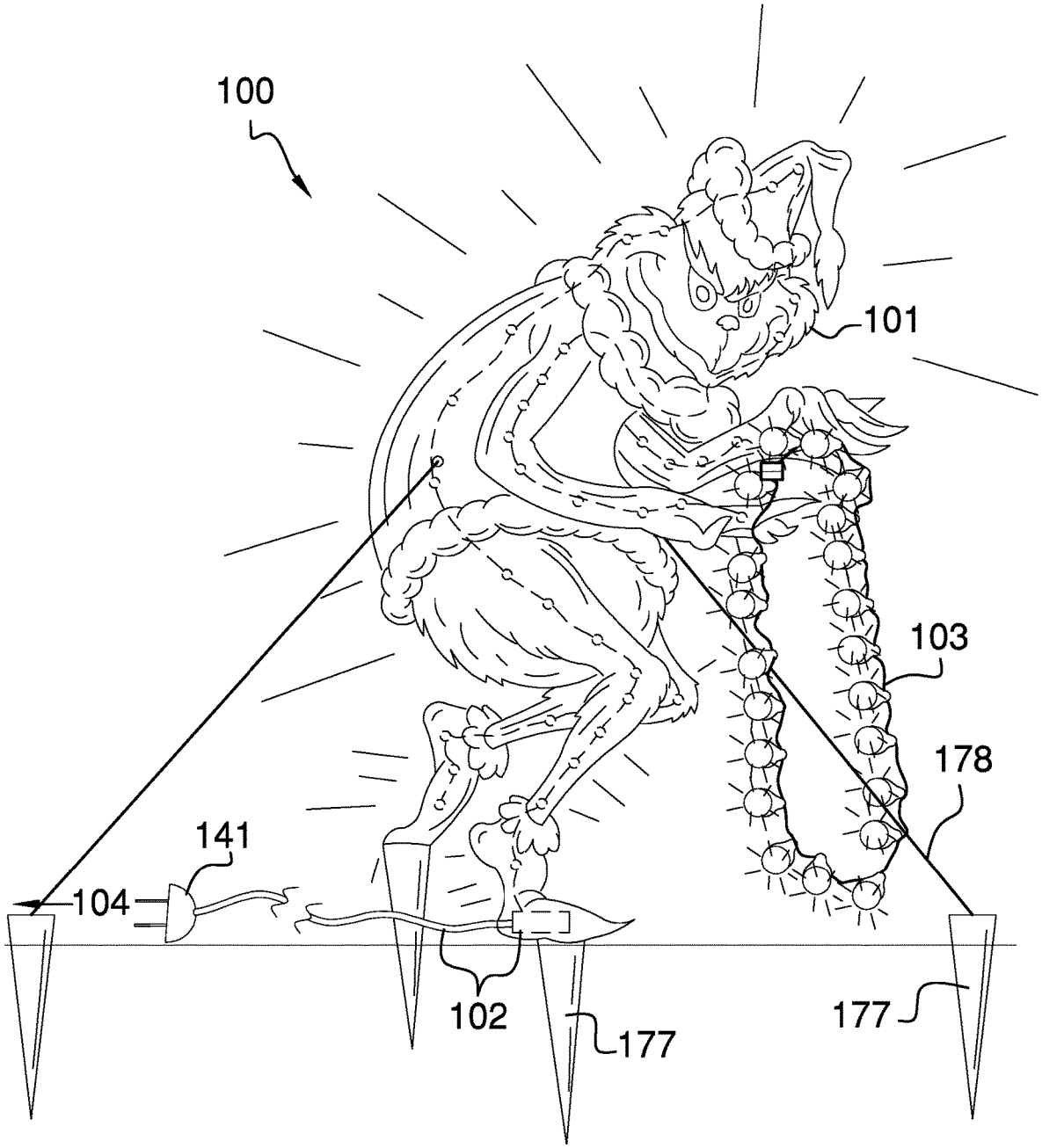
FIG. 1 is a front view of an embodiment of the disclosure.
Figure 2:
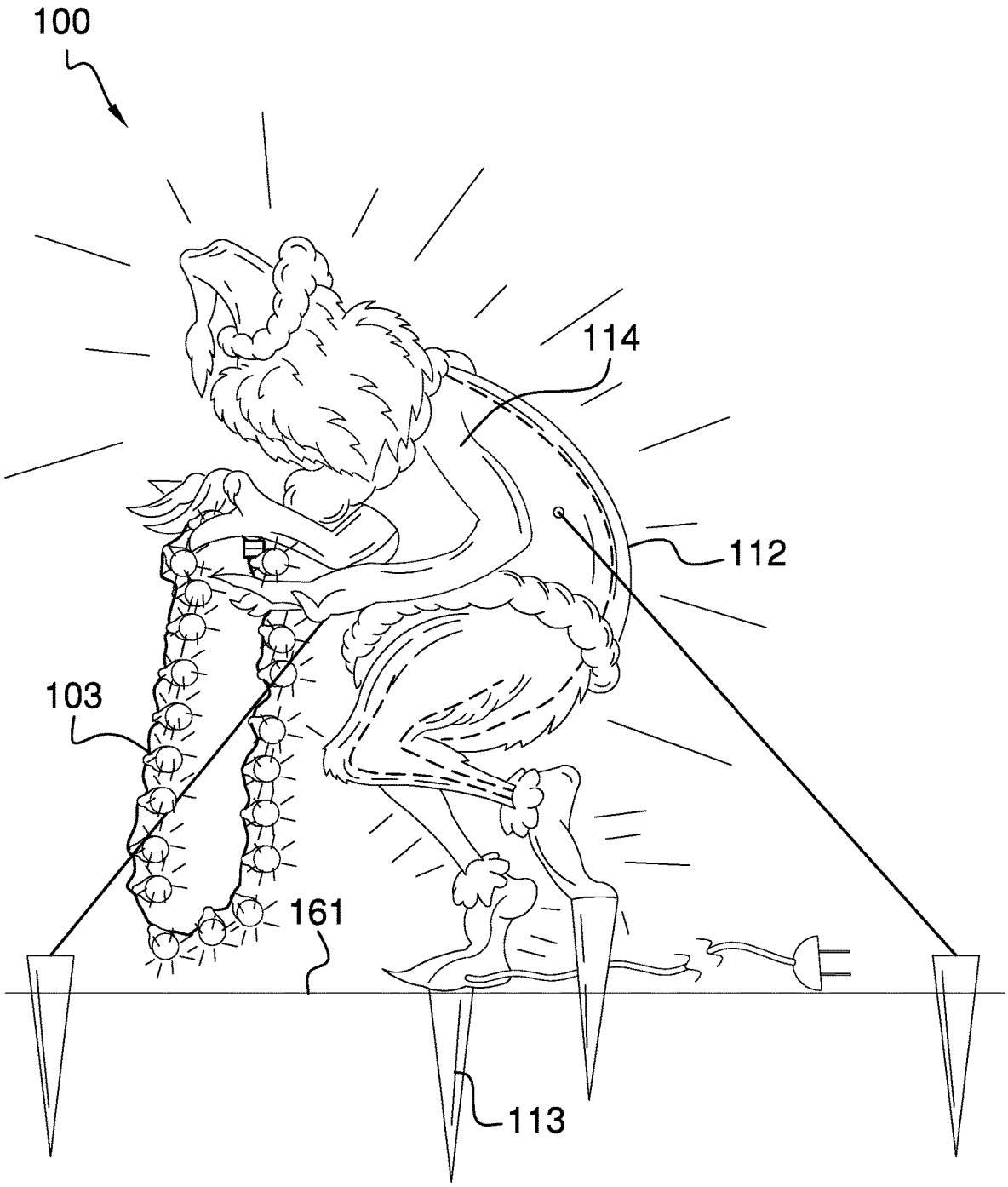
FIG. 2 is a rear view of an embodiment of the disclosure.
Figure 3:
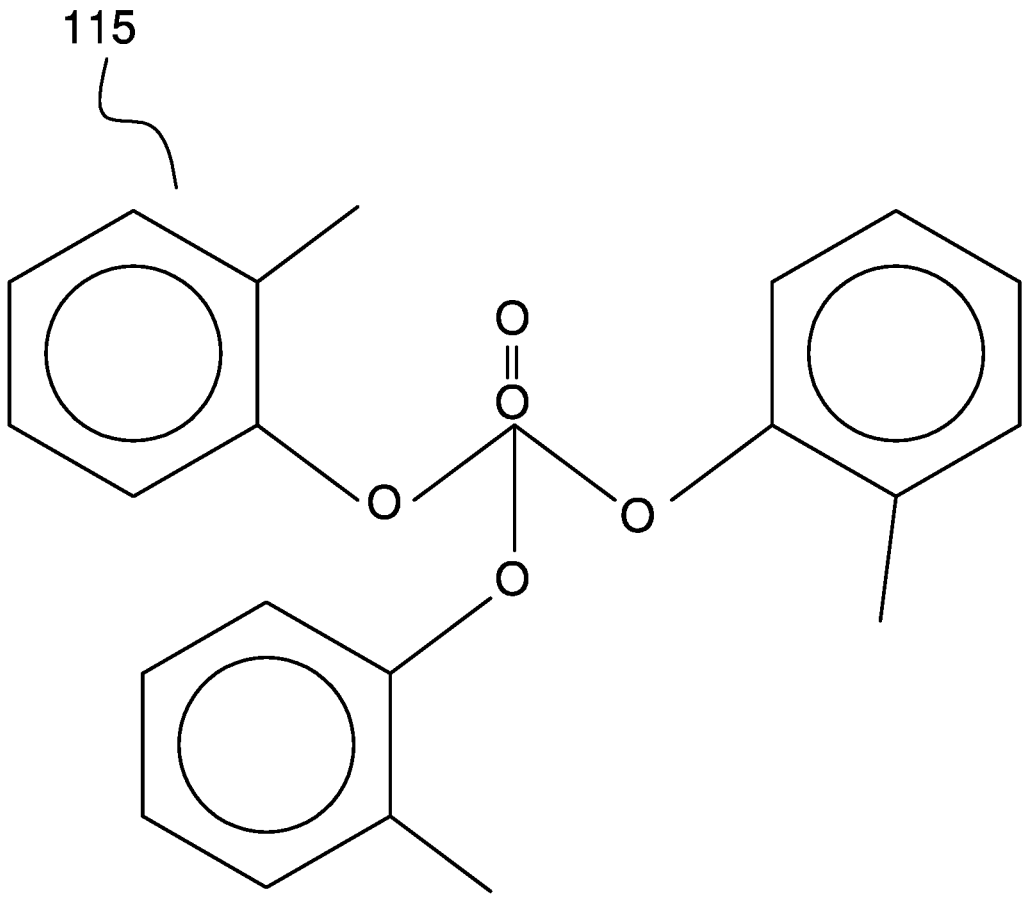
FIG. 3 is a detail view of an embodiment of the disclosure.
Figure 4:
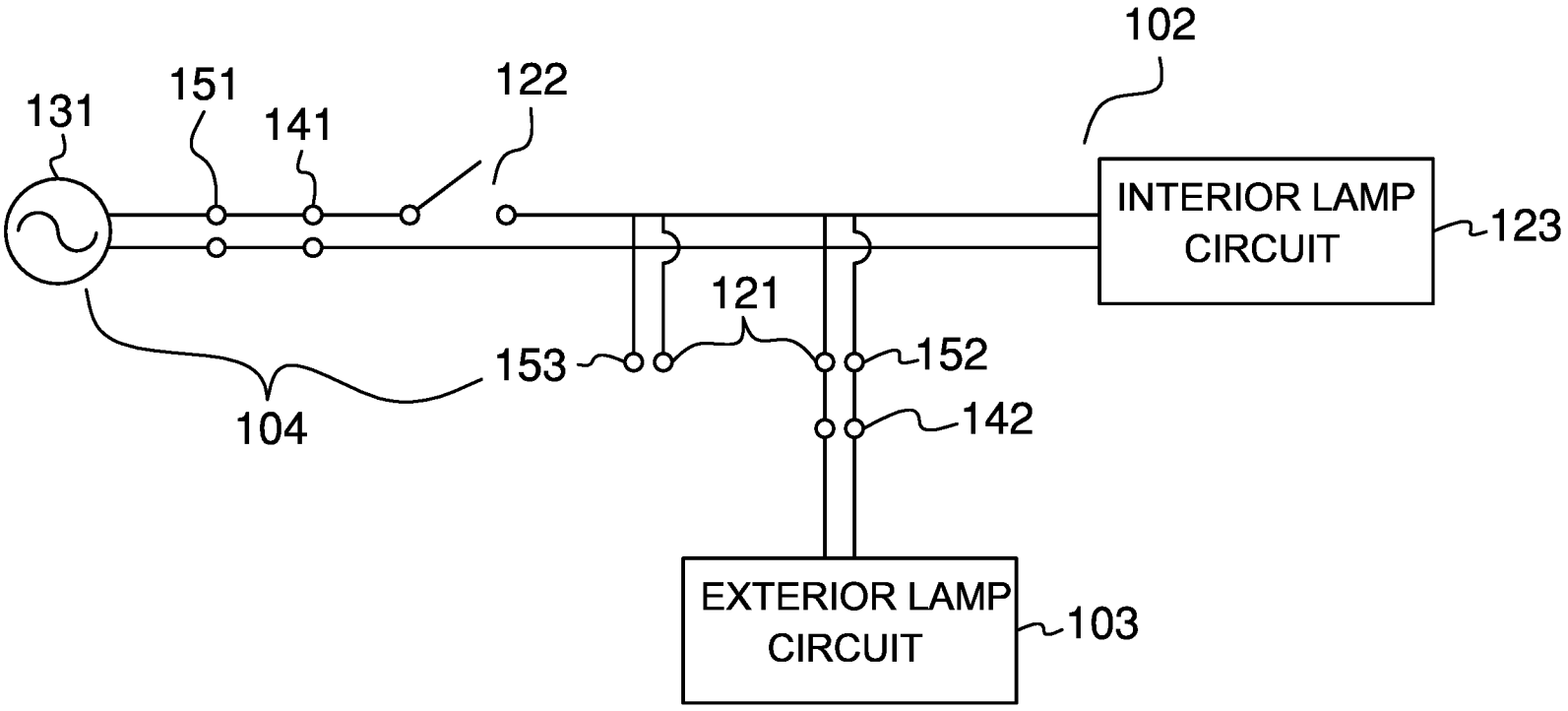
FIG. 4 is a schematic view of an embodiment of the disclosure.

Detailed reference will now be made to one or more potential embodiments of the disclosure, which are illustrated in FIGS. 1 through 4.

The illuminated outdoor figurine 100 (hereinafter invention) is a decorative structure. The invention 100 is an illuminating structure. The invention 100 is a self-supporting structure. The invention 100 rests on the ground 161. Any first instantiation of the invention 100 electrically connects with any second instantiation of the invention 100. The invention 100 comprises a figurine 101, a lighting circuit 102, an external lamp circuit 103, and an external power source 104. The figurine 101 is a decorative puppet structure. The figurine 101 has an elevation above the ground 161 of greater than 2 meters (roughly 78 inches) at its highest point. The figurine 101 contains the lighting circuit 102. The external lamp circuit 103 is suspended from the exterior surfaces of the figurine 101. The external power source 104 provides a source of electrical energy that powers the lighting circuit 102 and the external lamp circuit 103. The ground 161 is defined in greater detail elsewhere in this disclosure.

The external power source 104 is an externally provisioned source of electrical power. In the first potential embodiment of the disclosure, the external power source 104 comprises a national electric grid 131 and a first port 151. The first port 151 electrically connects the lighting circuit 102 to the national electric grid 131.

The national electric grid 131 is a commercially available source of electrical energy. The national electric grid 131 is defined in greater detail elsewhere in this disclosure.

The first port 151 is a NEMA 5-15 electrical socket. The NEMA 5-15 electrical socket is defined in greater detail elsewhere in this disclosure. The first port 151 provides access to the electrical power from the national electric grid 131. The first port 151 provides access to electrical power used to operate the lighting circuit 102. The first plug 141 of the lighting circuit 102 inserts into the first port 151.

The figurine 101 is a puppet. The image presented by the figurine 101 is selected for decorative purposes. The figurine 101 is a hollow structure. The figurine 101 contains the lighting circuit 102. The figurine 101 is a semi-transparent structure such that a portion of the illumination generated by the lighting circuit 102 passes through the exterior surface of the figurine 101. The figurine 101 is a self-standing structure. The figurine 101 anchors to the ground 161. The figurine 101 comprises a frame 111, a shell 112, and a stake 113. The shell 112 attaches to the frame 111. The stake 113 anchors the figurine 101 to the ground 161.

The frame 111 is a framework. The frame 111 is an openwork structure. The frame 111 forms a load path that transfers the load of the shell 112 and the lighting circuit 102 to the ground 161. The frame 111 is formed from a metal. The metal is selected from the group consisting of aluminum, copper, iron, and steel. In the first potential embodiment of the disclosure, the frame 111 is formed from metal shafts. The shell 112 attaches to the frame 111. The form factor of the frame 111 is such that when the shell 112 attaches to the frame 111, the figurine 101 exhibits an image with a form factor that is suitable for the decorative purposes of the invention 100.

The shell 112 is a flexible sheeting structure. The shell 112 has fire retardant properties. The shell 112 is a semi-transparent structure such that a portion of the illumination generated by the lighting circuit 102 passes through the exterior surface of the shell 112. The shell 112 attaches to the frame 111 such that the shell 112 forms the exterior surfaces of the figurine 101. The shell 112 displays an image that is suitable for the decorative purposes of the invention 100. The shell 112 comprises a textile 114 and tricresyl phosphate 115.

The textile 114 is a commercially available textile 114 based sheeting. The textile 114 attaches to the frame 111 such that the shell 112 forms the exterior surfaces of the figurine 101. The textile 114 has an image formed on it. The image formed on the textile 114 is suitable for the decorative purposes of the invention 100. The textile 114 displays the image such that the image is visible from the exterior of the invention 100. The textile 114 is a semi-transparent structure such that a portion of the illumination generated by the lighting circuit 102 passes through the exterior surface of the textile 114.

The tricresyl phosphate 115 is a chemical compound. The tricresyl phosphate 115 is applied to the textile 114. The tricresyl phosphate 115 is a chemical that is known to inhibit and interfere with the chemical processes associated with the combustion process. The application of the tricresyl phosphate 115 to the textile 114 gives the shell 112 its fire retardant properties.

The stake 113 is a shaft that attaches to the frame 111. The stake 113 anchors the figurine 101 to the ground 161 such 113 is driven into the ground 161 such that the figurine 101 is anchored to a fixed position.

The lighting circuit 102 is an electrical circuit. The lighting circuit 102 electrically connects to the external power source 104. The lighting circuit 102 generates illumination within the interior of the figurine 101. The lighting circuit 102 distributes electrical energy from the external power source 104 to the external lamp circuit 103. The lighting circuit 102 of any first instantiation of the invention 100 distributes electrical energy from the external power source 104 to the lighting circuit 102 of a second instantiation of the invention 100. The lighting circuit 102 comprises a plurality of ports 121, a maintained switch 122, an interior lamp circuit 123, and a first plug 141. The plurality of ports 121, the maintained switch 122, the interior lamp circuit 123, and the first plug 141 are electrically interconnected.

Each of the plurality of ports 121 is an electrical port. Each of the plurality of ports 121 provides access to electrical power to an electrical device selected from the group consisting of: a) the external power source 104; and, b) the lighting circuit 102 of a second instantiation of the invention 100. The plurality of ports 121 comprises a second port 152 and a third port 153.

The second port 152 is a NEMA 5-15 electrical socket. The NEMA 5-15 electrical socket is defined in greater detail elsewhere in this disclosure. The second port 152 provides access to the electrical power from the lighting circuit 102. The second port 152 provides access to electrical power used to operate the external lamp circuit 103. The second plug 142 of the external lamp circuit 103 inserts into the second port 152.

The third port 153 is a NEMA 5-15 electrical socket. The NEMA 5-15 electrical socket is defined in greater detail elsewhere in this disclosure. The third port 153 provides access to the electrical power from the lighting circuit 102. The third port 153 provides access to electrical power used to operate the lighting circuit 102 of a second instantiation of the invention 100. The first plug 141 of the lighting circuit 102 of the second instantiation of the invention 100 inserts into the third port 153 to form a daisy chain configuration between the second instantiation of the invention 100 and the first instantiation of the invention 100. The daisy chain configuration can be further extended by using the third port 153 of the second instantiation of the invention 100 to power a third instantiation of the invention 100.

The maintained switch 122 is a commercially available electrical switch. The maintained switch 122 controls the flow of electricity from a power source into the lighting circuit 102. The power source controlled by the maintained switch 122 is selected from the group consisting of the external power source 104 and the lighting circuit 102 of a first instantiation of the invention 100. The maintained switch 122 is effectively the power switch of the invention 100.

The interior lamp circuit 123 is an electrical circuit that operates as a lamp. The interior lamp circuit 123 generates the illumination within the interior of the figurine 101 that passes through the shell 112 of the figurine 101. In the first potential embodiment of the disclosure, the interior lamp circuit 123 is an LED rope that receives electrical energy through the maintained switch 122.

The first plug 141 is a NEMA 5-15P electrical plug. The NEMA 5-15P electrical plug is defined in greater detail elsewhere in this disclosure. The first plug 141 forms an electrical connection between the lighting circuit 102 and a port selected from the group consisting of: a) the first port 151 of the external power source 104; and, b) the third port 153 of the lighting circuit 102 of the first instantiation of the invention 100. The electrical energy required to operate the lighting circuit 102 is received through the first plug 141.

The external lamp circuit 103 is an electrical circuit. The external lamp circuit 103 electrically connects to the lighting circuit 102. The external lamp circuit 103 draws electrical power from the lighting circuit 102. The external lamp circuit 103 hangs from the exterior surfaces of the figurine 101. The external lamp circuit 103 generates illumination from the exterior surfaces of the figurine 101. The external lamp circuit 103 electrically connects to the lighting circuit 102. In the first potential embodiment of the disclosure, the external lamp circuit 103 is an LED rope.

The external lamp circuit 103 further comprises a second plug 142. The second plug 142 is a NEMA 5-15P electrical plug. The NEMA 5-15P electrical plug is defined in greater detail elsewhere in this disclosure. The second plug 142 forms an electrical connection between the second port 152 of the lighting circuit 102 and the external lamp circuit 103. The electrical energy required to operate the external lamp circuit 103 is received through the second port 152.

The invention 100 may employ ground-penetrating stakes 177 that penetrate the ground. Moreover, tie cables 178 may be used to provide greater stability for the invention 100.

The following definitions were used in this disclosure:

Anchor: As used in this disclosure, anchor means to hold an object firmly or securely.

Anchor Point: As used in this disclosure, an anchor point is a location to which a first object can be securely attached to a second object.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Daisy Chain: As used in this disclosure, daisy chain is a term that describes a series of objects that are linked together in a linear fashion. When referring to an electrical circuit, a daisy chain refers to a collection of electrical circuits interconnected using a series circuit.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Electric Circuit: As used in this disclosure, an electric circuit is a closed loop path through which electrons flow. The closed loop will generally initiate and terminate at an electrical power source.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Figurine: As used in this disclosure, a figurine is a three-dimensional structure resembling a human, animal, or symbolic image.

Fire Retardant: As used in this disclosure, a fire retardant is a chemical compound that inhibits or interferes with the chemical processes associated with combustion.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Frame: As used in this disclosure, a frame is a structure: a) to which an object attaches; and, b) which forms a portion of the load path of the object.

Framework: As used in this disclosure, a framework refers to the substructure of an object that carries the load path of the object.

Ground: As used in this disclosure, the ground is a solid supporting surface formed by the Earth. The term level ground means that the supporting surface formed by the ground is roughly perpendicular to the force of gravity.

Hang: As used in this disclosure, to hang an object is to suspend an object above a surface from above such that the inferior end of the object does not form a significant portion of the load path of the object.

Illumination: As used in this disclosure, light refers to electromagnetic radiation contained with an area. Illumination is a synonym for light, particularly in cases where a measure of the amount of visible electromagnetic radiation in a space is called for.

Instantiation: As used in this disclosure, an instantiation refers to a specific physical object or process that is created using a specification.

Interior: As used in this disclosure, the interior is used as a relational term that implies that an object is contained within the boundary of a structure or a space.

Lamp: As used in this disclosure, a lamp is a two terminal electrical device that generates (typically visible spectrum) electromagnetic radiation.

LED: As used in this disclosure, an LED is an acronym for a light emitting diode. A light emitting diode is a diode that is also a light source. Because of close operational correspondence of the function of the cathode and anode of an organic LEDs and the cathode and anode of a semiconductor LED, organic LEDs are included in this definition.

LED rope: As used in this disclosure, an LED rope is a commercially available lighting device. The LED rope is used LEDs to illuminate a space. The LED rope is a flexible cord structure. The illuminating LEDs are distributed along the span of the length of the cord. The LED rope mounts on a surface. The flexible nature of the LED rope allows the LED rope to bend around corners during installation. The LED rope draws power from the national electric grid. While there are minor technical differences, this definition is intended to include LED rope like products commonly marketed as LED strips.

Light: As used in this disclosure, light refers to electromagnetic radiation that illuminates an area. Illumination is a synonym for light, particularly in cases where a measure of the amount of light in a space is called for.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Maintained Switch: A used in this disclosure, a maintained switch is a switch that maintains the position that was set in the most recent switch actuation. A maintained switch works in an opposite manner to a momentary switch.

Metal: As used in this disclosure, a metal is an element that readily loses electrons or an alloy formed from a plurality of such elements. General properties of metals include, but are not limited to, the ability to conduct heat, conduct electricity, malleability, and the ability to be drawn into a wire. For the purposes of this disclosure, the term metal is assumed to include the transition metals (columns 3-12 of the periodic table) and aluminum, tin, and lead. The alkali metals (columns 1 of the periodic table) and the alkali earth metals (column 2 of the periodic table) are assumed to be excluded from this definition. In this disclosure, the preferred metals of choice are aluminum, copper, iron, and iron-based mixtures of metals commonly referred to as steel.

National Electric Grid: As used in this disclosure, the national electric grid is a synchronized and highly interconnected electrical network that distributes energy in the form of electric power from a plurality of generating stations to consumers of electricity. The national electric grid is a commercially available source of AC electrical power. The national electric grid is regulated by an appropriate authority. The national electric grid sells electrical power for use by an electrical load. The national electric grid invoices for electrical power based on the total energy consumed by the electrical load. The national electric grid measures the energy consumption of an electrical load with an electrical meter.

NEMA: As used in this disclosure, NEMA is an acronym for National Electric Manufacturers Association. NEMA is a manufacturer's association known for publishing widely accepted technical standards regarding the performance of electrical power distribution equipment.

NEMA 5-15 Electrical Socket: As used in this disclosure, the NEMA 5-15 electrical socket is a port designed to provide electric power drawn from a source of electrical power consistent with the electrical power received through the National Electric Grid. The NEMA 5-15 electrical socket is commonly used to deliver electrical power to electric devices in residential, office, and light industrial settings. The typical NEMAS-15 electrical socket comprises a plurality of electric ports from which electric power is drawn. The position of each of the plurality of electric ports is placed in a standardized position. The typical NEMAS-15 electrical socket further comprises a plate hole which is a standardized hole located in a standardized position within the NEMA 5-15 electrical socket that that is designed to receive a bolt that is used to attach a faceplate to the NEMA 5-15 electrical socket. The NEMA 5-15 electrical socket is also commonly referred to as an electrical outlet.

NEMA 1-15P Electrical Plug: As used in this disclosure, the NEMA 1-15P Electrical Plug is a plug that is designed to be inserted into a NEMA 5-15 Electrical Socket for the purpose of delivering electrical power to electrical devices. The NEMA 1-15P Electrical Plug is a 2 blade plug that is commonly found within residential and office environments within the United States.

NEMA 5-15P Electrical Plug: As used in this disclosure, the NEMA 5-15P Electrical Plug is a plug that is designed to be inserted into a NEMA 5-15 Electrical Socket for the purpose of delivering electrical power to electrical devices. The NEMA 5-15P Electrical Plug is a 3 blade plug that is commonly found within residential and office environments within the United States.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Openwork: As used in this disclosure, the term open work is used to describe a structure, often a surface, which is formed with one or more openings that allow for visibility and fluid flow through the structure. Wrought work and meshes are forms of openwork.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Puppet: As used in this disclosure, a puppet is a three-dimensional figure resembling a human, animal, or symbolic image that is used for entertainment or educational purposes.

Reduction-Oxidation Reaction: As used in this disclosure, a reduction-oxidation reaction (also known as a redox reaction) is a chemical reaction involving the transfer of electrons between the reactants of the reaction.

Roughly: As used in this disclosure, roughly refers to a comparison between two objects. Roughly means that the difference between one or more parameters of the two compared objects are not significantly different.

Self-Supporting: As used in this disclosure, self-supporting refers to a mechanical structure that: a) remains stable on a supporting surface; without, b) requiring the transfer of a portion of the load of the mechanical structure to load paths provided by structures that are independent of the mechanical structure.

Semitransparent: As used in this disclosure, semitransparent refers to an object that is partially transparent.

Sheeting: As used in this disclosure, a sheeting is a material, such as a paper, textile, a plastic, or a metal foil, in the form of a thin flexible layer or layers.

Shell: As used in this disclosure, a shell refers to the exterior surfaces of an object.

Stake: As used in this disclosure, a stake is a shaft that is driven into a horizontal surface, such as the ground, to serve as an anchor point.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Textile: As used in this disclosure, a textile is a material that is woven, knitted, braided or felted. Synonyms in common usage for this definition include fabric and cloth.

Transparent: As used in this disclosure, transparent refers to a material that allows light to pass through the material without significant scattering such that an object can be clearly seen through the material.

Tricresyl Phosphate: As used in this disclosure, tricresyl phosphate (CAS 1330-78-5) refers to a chemical compound with the formula C21H21O4P. Tricresyl phosphate has multiple industrial uses including, but not limited to, an additive to enhance fire retardance, hydraulic fluid, heat exchange fluid, and a fuel and lubricant additive. Tricresyl phosphate remains liquid over a wide temperature range (melting point −40 C to boiling point 200 C) which makes it a common choice in situations where a broad range of environmental conditions are anticipated.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An illuminated decorative puppet comprising
a figurine, a lighting circuit, an external lamp circuit, and an external power source;
wherein the figurine contains the lighting circuit;
wherein the external lamp circuit is suspended from an exterior surface of the figurine;
wherein the external power source provides a source of electrical energy that powers the lighting circuit and the external lamp circuit;
wherein the illuminated decorative puppet is a decorative structure;
wherein the illuminated decorative puppet is an illuminating structure;
wherein the illuminated decorative puppet is a self-supporting structure;
wherein the illuminated decorative puppet rests on the ground;
wherein any first instantiation of the illuminated decorative puppet electrically connects with any second instantiation of the illuminated decorative puppet;
wherein the figurine is a puppet;
wherein the figurine is a hollow structure;
wherein the figurine is a semi-transparent structure such that a portion of an illumination generated by the lighting circuit passes through the exterior surface of the figurine;
wherein the figurine is a self-standing structure;
wherein the figurine anchors to the ground;
wherein an interior lamp circuit is an electrical circuit that operates as a lamp;
wherein the interior lamp circuit generates the illumination within an interior of the figurine that passes through a shell of the figurine;
wherein the interior lamp circuit is an LED rope;
wherein the figurine is a decorative puppet structure;
wherein the figurine has an elevation above the ground of greater than 2 meters at its highest point;
wherein the external power source comprises a national electric grid and a first port;
wherein the first port electrically connects the lighting circuit to the national electric grid;
wherein the first port provides access to an electrical power from the national electric grid;
wherein the lighting circuit is an electrical circuit;
wherein the lighting circuit electrically connects to the external power source;
wherein the lighting circuit generates illumination within an interior of the figurine;
wherein the lighting circuit distributes electrical energy from the external power source to the external lamp circuit;
wherein the lighting circuit of any first instantiation of the illuminated decorative puppet distributes electrical energy from the external power source to the lighting circuit of a second instantiation of the illuminated decorative puppet;
wherein the external lamp circuit is an electrical circuit;
wherein the external lamp circuit electrically connects to the lighting circuit;
wherein the external lamp circuit draws electrical power from the lighting circuit;
wherein the external lamp circuit generates illumination;
wherein the figurine comprises a frame, a shell, and a stake;
wherein the shell attaches to the frame;
wherein the stake anchors the figurine to the ground;
wherein the lighting circuit comprises a plurality of ports, a maintained switch, an interior lamp circuit, and a first plug;
wherein the plurality of ports, the maintained switch, the interior lamp circuit, and the first plug are electrically interconnected.

2. The illuminated decorative puppet according to claim 1
wherein the frame is a framework;
wherein the frame is an openwork structure;
wherein the frame forms a load path that transfers a load of the shell and the lighting circuit to the ground;
wherein the frame is formed from metal shafts.

3. The illuminated decorative puppet according to claim 2
wherein the shell is a flexible sheeting structure;
wherein the shell has fire retardant properties;
wherein the shell is a semi-transparent structure such that a portion of the illumination generated by the lighting circuit passes through the exterior surface of the shell;
wherein the shell attaches to the frame such that the shell forms the exterior surface of the figurine;
wherein the shell displays an image that is suitable for a decorative purpose of the illuminated decorative puppet.

4. The illuminated decorative puppet according to claim 3
wherein the stake is a shaft that attaches to the frame;
wherein the stake anchors the figurine to the ground such that the figurine is a self-supporting structure;
wherein the stake is driven into the ground such that the figurine is anchored to a fixed position.

5. The illuminated decorative puppet according to claim 4
wherein each of the plurality of ports is an electrical port;
wherein each of the plurality of ports provides access to electrical power to an electrical device selected from the group consisting of: a) the external power source; and, b) the lighting circuit of a second instantiation of the illuminated decorative puppet.

6. The illuminated decorative puppet according to claim 5
wherein the maintained switch controls a flow of electricity from a power source into the lighting circuit;
wherein the power source controlled by the maintained switch is selected from the group consisting of the external power source and the lighting circuit of a first instantiation of the illuminated decorative puppet.

7. The illuminated decorative puppet according to claim 6 wherein the shell comprises a textile and a fire retardant chemical;

wherein the fire retardant chemical is applied to the textile.

8. The illuminated decorative puppet according to claim 7 wherein the textile is a textile-based sheeting;

wherein the textile attaches to the frame such that the shell forms the exterior surfaces of the figurine;

wherein the textile has an image formed on it;

wherein the image formed on the textile is suitable for the decorative purposes of the illuminated decorative puppet;

wherein the textile displays the image such that the image is visible from the exterior of the illuminated decorative puppet;

wherein the textile is a semi-transparent structure such that a portion of the illumination generated by the lighting circuit passes through the exterior surface of the textile.

9. The illuminated decorative puppet according to claim 8 wherein the fire retardant chemical is tricresyl phosphate.

10. The illuminated decorative puppet according to claim 9 wherein the first port is a NEMA 5-15 electrical socket;

wherein the first port provides access to electrical power used to operate the lighting circuit;

wherein the first plug of the lighting circuit inserts into the first port.

11. The illuminated decorative puppet according to claim 10 wherein the plurality of ports comprises a second port and a third port;

wherein the second port is a NEMA 5-15 electrical socket;

wherein the third port is a NEMA 5-15 electrical socket;

wherein the second port provides access to the electrical power from the lighting circuit;

wherein the second port provides access to electrical power used to operate the external lamp circuit;

wherein the second plug of the external lamp circuit inserts into the second port;

wherein the third port provides access to the electrical power from the lighting circuit;

wherein the third port provides access to electrical power used to operate the lighting circuit of a second instantiation of the illuminated decorative puppet;

wherein the first plug of the lighting circuit of the second instantiation of the illuminated decorative puppet inserts into the third port to form a daisy chain configuration between the second instantiation of the illuminated decorative puppet and the first instantiation of the illuminated decorative puppet.

12. The illuminated decorative puppet according to claim 11 wherein the first plug is a NEMA 5-15P electrical plug;

wherein the first plug forms an electrical connection between the lighting circuit and a port selected from the group consisting of: c) the first port of the external power source; and, d) the third port of the lighting circuit of the first instantiation of the illuminated decorative puppet;

wherein the external lamp circuit further comprises a second plug;

wherein the second plug is a NEMA 5-15P electrical plug;

wherein the second plug forms an electrical connection between the second port of the lighting circuit and the external lamp circuit.

* * * * *